US006527545B2

(12) United States Patent
Cook

(10) Patent No.: US 6,527,545 B2
(45) Date of Patent: Mar. 4, 2003

(54) CIGARETTE/CIGAR CUTTING AND LIGHTER DEVICE

(76) Inventor: David W. Cook, P.O. Box 55, Mitchells, VA (US) 22729

( * ) Notice: Subject to any disclaimer, the term of this patent is extended or adjusted under 35 U.S.C. 154(b) by 0 days.

(21) Appl. No.: 09/849,517

(22) Filed: May 7, 2001

(65) Prior Publication Data

US 2001/0029002 A1 Oct. 11, 2001

Related U.S. Application Data

(63) Continuation-in-part of application No. 09/520,327, filed on Mar. 7, 2000, now abandoned.

(60) Provisional application No. 60/123,868, filed on Mar. 11, 1999.

(51) Int. Cl.[7] ..... A24F 15/08; A24F 13/24; F23Q 2/34

(52) U.S. Cl. ..... 431/253; 431/277; 30/109; 30/113; 30/123; 131/249

(58) Field of Search ..... 431/253, 277; 30/113, 112, 111, 123, 109; 131/248, 249, 250, 250.1

(56) References Cited

U.S. PATENT DOCUMENTS 642,520 A * 1/1900 Fontneau
691,372 A * 1/1902 Grothe
715,315 A * 12/1902 Steinecke
826,232 A * 7/1906 Dowsey
1,058,999 A * 4/1913 Patten
1,068,300 A * 7/1913 Baumbach
1,186,771 A * 6/1916 Hammann
1,199,784 A * 10/1916 Hall
2,777,569 A * 1/1957 Starke
3,744,958 A * 7/1973 Coberg
5,934,894 A * 8/1999 Cigler
6,049,984 A * 4/2000 McGehee
6,062,227 A * 5/2000 Kuenzel
6,079,425 A * 6/2000 Hamer
6,151,781 A * 11/2000 Dehler

FOREIGN PATENT DOCUMENTS

FR 2684523 * 6/1993 ..... 431/253

* cited by examiner

*Primary Examiner*—Carl D. Price
(74) *Attorney, Agent, or Firm*—Glenna Hendericks

(57) ABSTRACT

This invention provides cutter/lighter combination devices wherein the cutter is equipped with a blade attached to a holder that moves on a track. The end of the blade holder distal from the blade edge protrudes from a notch in the side of the case. When the protruding portion of the blade carrier is pushed forward in the direction of the case, the blade moves forward across the aperture to cut any object which has been inserted into the aperture. The blade edge may be any shape, so long as the cutting edge is not present in the aperture in the absence of pressure on the blade carrier to force the blade edge to move the blade across the aperture.

4 Claims, 5 Drawing Sheets

CIGARETTE/CIGAR CUTTING AND LIGHTER DEVICE

This application is a continuation-in-part of U.S. patent application Ser. No. 09/520,327, filed Mar. 7, 2000, now abandoned, which claims the benefit of priority from U.S. Provisional Patent Application Ser. No. 60/123,868, filed Mar. 11, 1999.

FIELD OF THE INVENTION

The present invention relates to a versatile cost-saving combination lighter-cutter in a compact casing. A smoothly serrated casing with an optional lighter device may be used if desired.

BACKGROUND OF THE INVENTION

The relevant art of interest describes various cigar and cigarette cutting devices. It was observed that smokers on their breaks frequently threw away burning cigars, cigarillos or cigarettes with a large unburnt length. Therefore, a convenient compact cigar or cigarette cutter device was envisioned which could be carried in a smoker's pocket or purse and quickly utilized to cut the burning end off to save the remainder of the unburnt cigar or cigarette for future smoking. Especially today, the cost of cigars, cigarillos and cigarettes has increased drastically. This device can reduce the cost of smoking. None of the relevant art shows or suggests the present invention. The relevant art will be discussed in the order of perceived relevance to the present invention.

U.S. Pat. No. 5,819,753 issued on Oct. 12, 1998, to Birkenthal describes a cigarette severing device having a flat elongated housing with an aperture at one end. A slide button in an elongated slot moves an elongated blade forward. As the cutter blade enters the aperture, a mechanism draw the blade tightly against one of the sides of the housing to effect a clean cut. The device is distinguishing for its ornamentally different blade and case structure.

U.S. Pat. No. 46,053 issued on Jul. 7, 1914, to Joseph Kaufman describes a cigar cutter having a housing open on three sides with an aperture at one end and a pivot pin at the opposite end to hold a single edged razor blade with a scalloped back reinforcement. The top edges of the open housing interfit with the scalloped back of the pivoting razor blade. The device is distinguishable for its structurally different blade and case structure.

U.S. Pat. No. 5,715,602 issued on Feb. 10, 1998, to Stephen H. Hage describes a cigar tip cutter comprising a rectangular plastic two-piece housing braving a centered hole and semicircular handles at each end attached to separate planar cutting blades with U-shaped cutting edges. When the handles are initially squeezed together, locking friction gives way, the blades move through guide rails, and the U-shaped cutting edges cut through a cigar tip with a pincer movement. The device in the closed position is 3.75 in. long and 1.5 in. wide. The hole is 0.75 in. in diameter. The plastic housing and other plastic parts can be made from acrylonitrile-butadiene-styrene (ABS), polystyrene, nylon (body), or Delrin. The cutting blades can be stainless steel. The cigar cutting device is distinguishable for its reliance on two moving cutting blades.

U.S. Pat. No. 5,303,721 issued on Apr. 19, 1994 to Larry Bowen et al. describes a cigarette snipping device for removing the burnt end of a partially-smoked cigarette to expose fresh tobacco for relighting the cigarette. A planar elongated housing with two snap-together molded parts has arcuate cutouts on each side exposing the side arms of a cutter for squeezing the cutting blades together to cut the cigarette butt in the aperture in one end of the housing. The device is distinguishable for its requirement for two moving cutting blades.

U.S. Pat. No. 5,791,051 issued on Aug. 11, 1998, to G. Gerry Schmidt describes a cigar cutter comprising a planar rectangular housing having a cigar tip receiving aperture, and a cigar tip cutoff blade having an inclined cutting edge mounted on a slide telescopically fitted to the housing from the bottom and manually operated to move the blade. The slide has lateral guides and is pushed into the housing's channels against the bias of a spring. A push-button release system permits the extension of the cutoff blade out of the housing. The cigar cutter is distinguishable for its telescopic slide and cutter blade mechanism.

U.S. Pat. No. 4,837,931 issued on Jun. 13, 1989, to Edwald H. Beermann describes a cigar tip or plastic rod cutter device having two housing halves. The cutter assembly comprises three parts which are a blade holder, a pivoting knife and a blade cover. The U-shaped blade holder has holder holes for the pins of the blade cover. The rod cutter has a constricted center for a better grip and a hole for cutting the rod. The blade holder has the knife blade held in place by a pair of pins in the cover. The rod is cut at an angle of 45 degrees by inclined blade holder guides in the preferred embodiment or a 90 degree cut is made by normal guides in a second embodiment. The rod cutter device is distinguishable for its heavy duty purpose and off-angled cut by a single blade.

German Patent No. 572,673 issued on Mar. 2, 1933, for Johannes Marquardt et al. describes as best understood a cigar and cigarette cutter having two apertures on one end. An inclined blade edge is inserted in a planar housing with a push block on an opposite end. The blade has an upper notch for preventing the blade from traversing too far in and too far out by cooperating with a stop in the housing. The blade can have an upper and/or a lower guide hook pressing against the inside of the housing as well as a return spring between the push block and positioned in a notch in the blade and anchored in the housing. The housing can have arcuate notches at its ends or a single arcuate groove at the end opposite the push block ostensibly for squeezing the housing and push block to cut a cigar or cigarette. The devices are distinguishable for having two apertures and a squeeze together operative structure.

U.K. Patent Application No. 780 published on Oct. 22, 1914, for Herbert D. Jackson describes a cigar or cigarette cutter formed by two sheet metal stampings with holes. The inner member has a lip on an outside edge, a countersunk cutting hole with a sharp edge, and a projection or pip at the opposite end for sliding in the outer member for cutting. The outside member has rolled over edges on three sides so as to guide the inside member to cut the inserted cigar or cigarette. Apparently, the diameter of the hole is not altered for cutting cigars and cigarettes having different diameters. The cutter is distinguishable for its push in structure.

U.K. Patent Application No. 139,279 published on Mar. 4, 1920, for Ernest N. Kennedy describes a cigar cutter comprising a double edged razor blade holder hinged to a handle analogous to a folding pocket knife. The handle has serrated openings at its bottom edge so that the folded razor blade holder can still cut for shaving. A cigar cutting hole is included in the handle. The multiple use device is limited to is pocket knife structure for cutting the end of a cigar.

None of the above inventions and patents, taken either singly or in combination, is seen to disclose the instant invention as claimed.

SUMMARY OF THE INVENTION

The invention is a cigarette/cigar cutting device with or without a lighter element. The devices comprises a case having a front wall, a rear wall, a top wall, a bottom wall, a right sidewall and a left sidewall; an aperture aligned in each of said front and rear walls; a blade attached to a blade carrier, said carrier positioned to travel in a track and wherein said blade carrier extends outside of said cast through a notch in said case; a spring lying in said track positioned between the end of said track and the portion of the blade carrier riding in said track, and a lighter component positioned in said case such a manner that it does not intrude upon any region occupied any part of the device related to the cutting function. When the elements are combined as disclosed herein, the case should be sufficiently think to fit neatly into a shirt pocket. If desired, an ergonomic case having grooves on each side for providing a firm yet comfortable hand grip may be used to house the working elements of the invention. The casing may be formed from two halves which are joined together after insertion of the required parts.

In one embodiment of the device a likable button at one corner is attached to a pivoting rod biased by a return spring and supports a trapezoidal cutting blade. A grooved and indented cutting stop block which abuts the walls of the case and aligned with a cutting aperture in the device permits the insertion of the cigarette or cigar for cutting off a length to eliminate the burned end or cut a new cigar tip. A lighter may be added to the device, which may, if desired, utilize a likable push-in button which pushes against a compression spring at the hinged end to swing down the blade against a grooved and indented cutting stop block.

In a preferred embodiment of the invention, a blade is attached to a holder that moves on a track. The end of the blade holder distal from the blade edge protrudes from a notch in the side of the case. When the protruding portion of the blade carrier is pushed forward in the direction of the case, the blade moves forward across the aperture to cut any object which has been inserted into the aperture. The blade edge may be any shape, so long as the cutting edge is not present in the aperture in the absence of pressure on the blade carrier to force the blade edge to move the blade across the aperture.

A primary object of the invention is to provide a combination cigar/cigarette cutter and lighter device having a blade which will not be exposed when no object requiring cutting is placed in the aperture. The invention provides improved alignment of elements and can be produced and made available at little cost.

BRIEF DESCRIPTION OF THE DRAWINGS

FIG. 5 shows views of a cutter/lighter having a cutting blade held on a blade holder which is manipulated by pushing on a portion of the blade holder protruding from the casing. FIG. 5(A) shows a perspective front view; while

Figure 1:
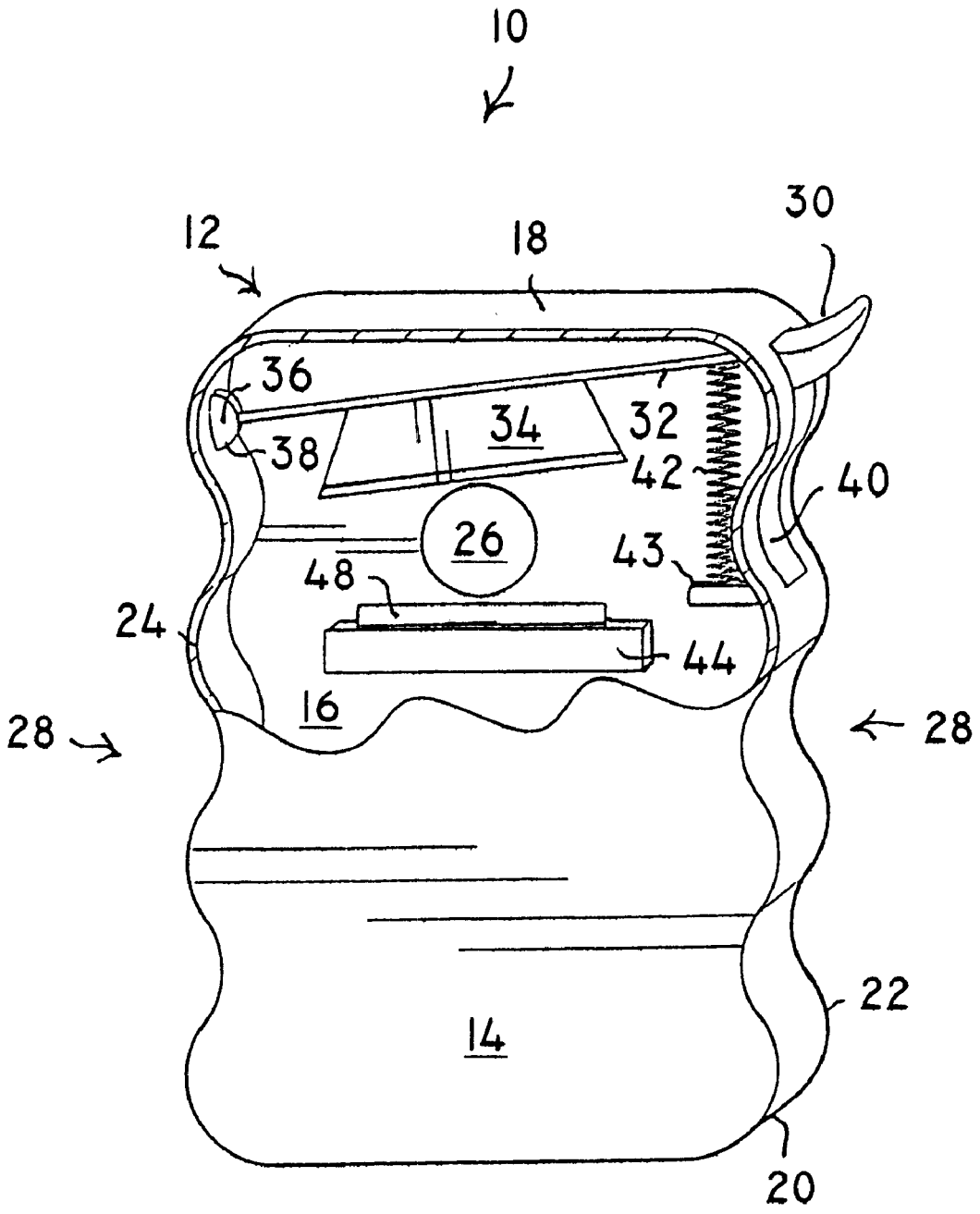
FIG. 1 is a perspective front view of a cigarette/cigar cutting device with a partial breakaway of an upper portion of the front cover according to a first embodiment of the present invention.

Reference characters denote corresponding features consistently throughout the attached drawings.

DETAILED DESCRIPTION OF THE INVENTION

The present invention is drawn to devices which may incorporate both a lighter and a cutter. One embodiment shown in FIG. 1 is a cigar or cigarette cutter device 10 without a lighter. Disclosed in FIG. 1 is an ergonomic case 12 having a front wall 14, a rear wall 16, a top wall 18, a bottom wall 20, a right sidewall 22, and a left sidewall 24. Aligned apertures 26 are formed in the front wall 14 and the rear wall 16 for insertion of the cigar or cigarette. Three grooves 28 are formed on each sidewall 22, 24 of the case 12 for firm placement of the fingers (not shown). While any size case may be used, a convenient size would be about 2–4 inches long, 1.5 to 2.5 inches wide and 0.15 to 0.5 inches thick. The case 12 may be formed from two halves which are bonded by, for example, heat or adhesive after all the functioning elements have been installed.

In one embodiment, a thumb button 30 with a push-in safety pin 46 in a notch of the case 12 is attached to one end of a cutting arm 32 supporting a trapezoidal cutting blade 34 with the cutting edge having the longest dimension. The opposite end of the cutting arm 32 pivots downward from a pin 36 in a bracket 38. The thumb button 30 is pushed down in a slot 40 and against a spring coil 42 attached to it and resting on a ledge 43, which spring will return the thumb button 30 to the starting position.

Figure 2:
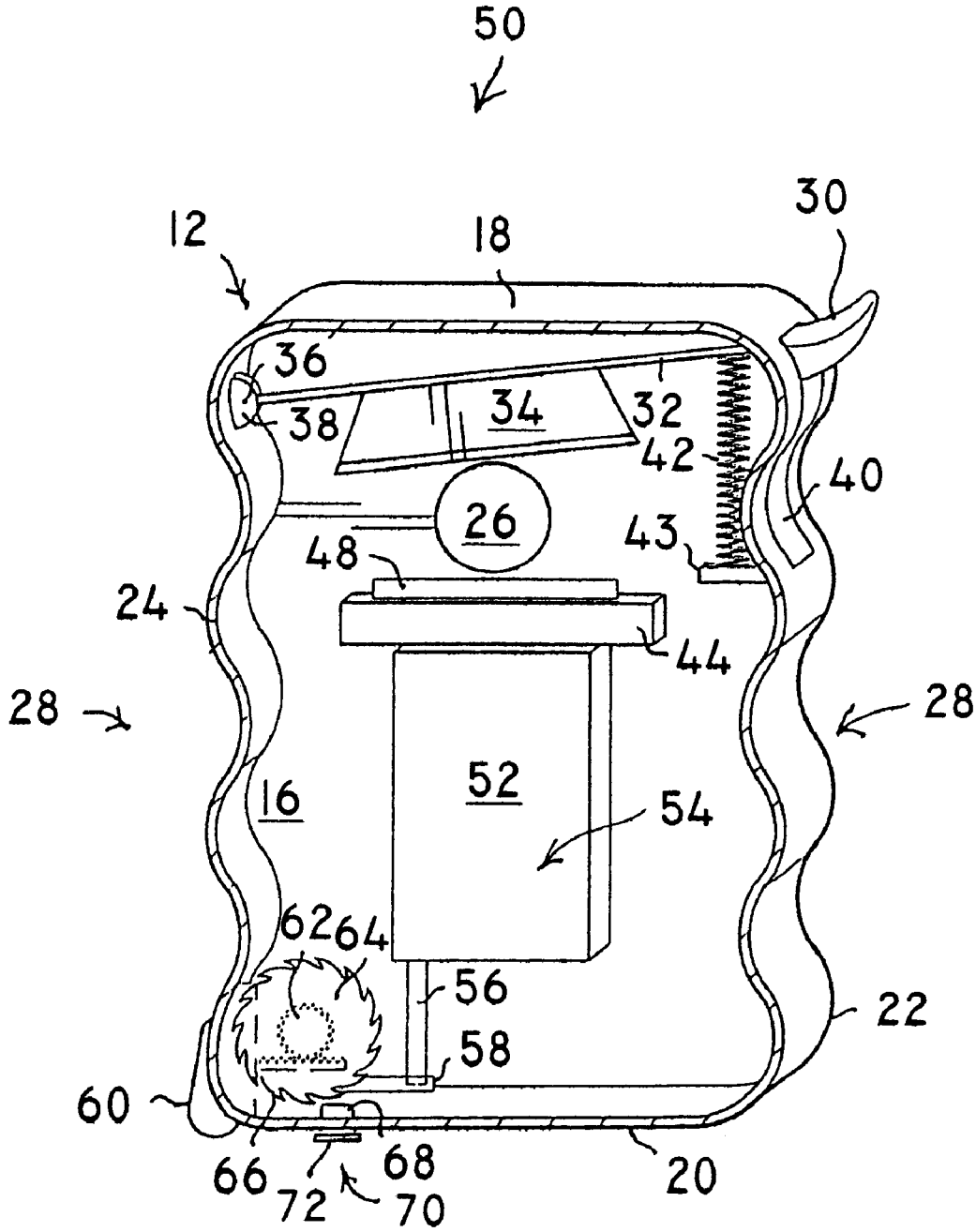
FIG. 2 is a perspective front view of a combination cigarette/cigar cutting and lighter device with a breakaway of the front wall according to a second embodiment of the present invention.

FIGS. 1 and 2 have generic horizontal metal stop block elements 44 having a longitudinal groove 48 and an arcuate notch 49 for accepting the cutting blade 34 and the cigar or cigarette tip, respectively. The stop block element 44 is positioned at least 1/16 in. up into the region exposed by the apertures 26. The metal stop block element 44 abuts the front and rear walls 14, 16 to form a stable and secure formation. As the top cutting blade 34 cuts down, it will be stopped by the longitudinal groove 48 in the metal stop block element 44.

Figure 3:
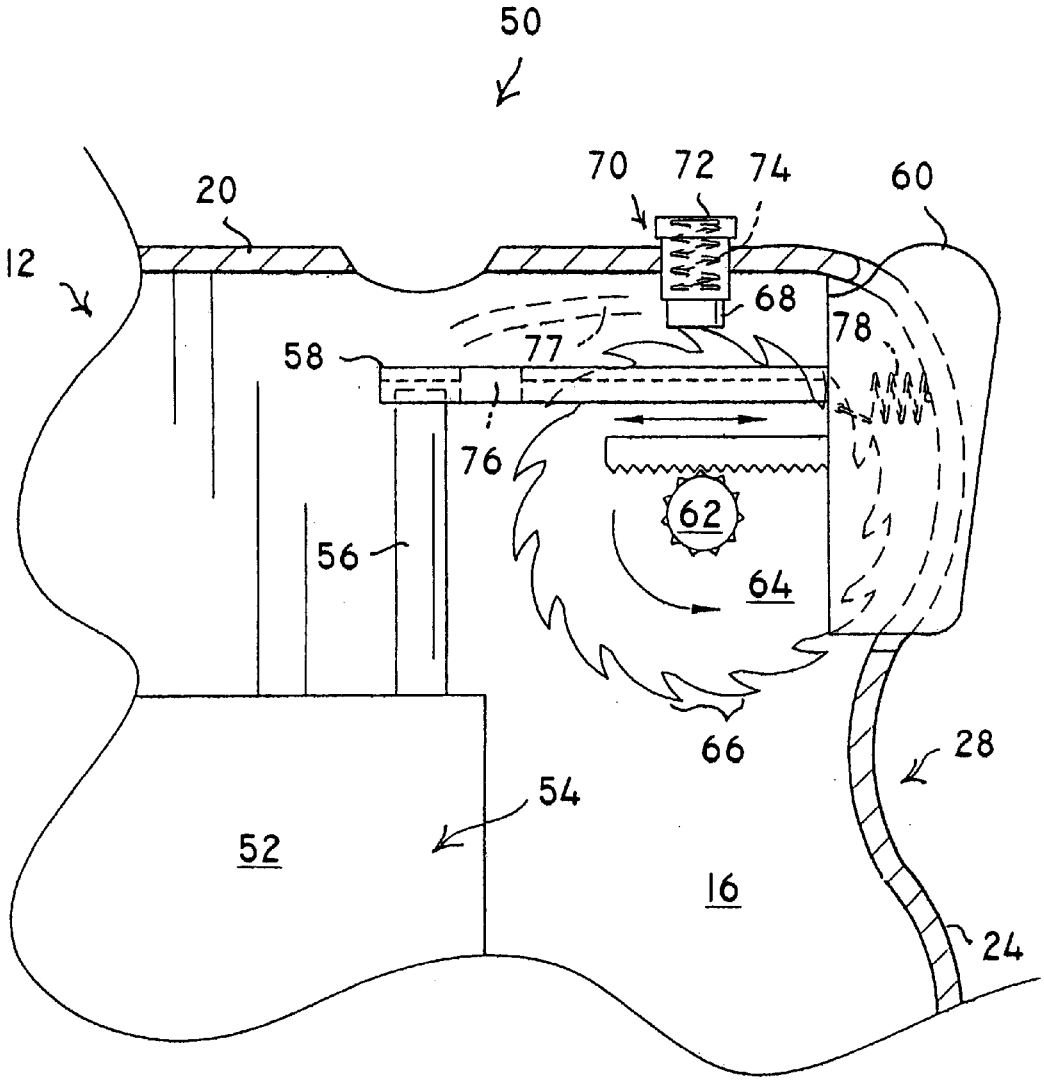
FIG. 3 is a partial breakaway front view of the lighter portion of the inverted combination cigarette/cigar cutting and lighter device.
Figure 4:
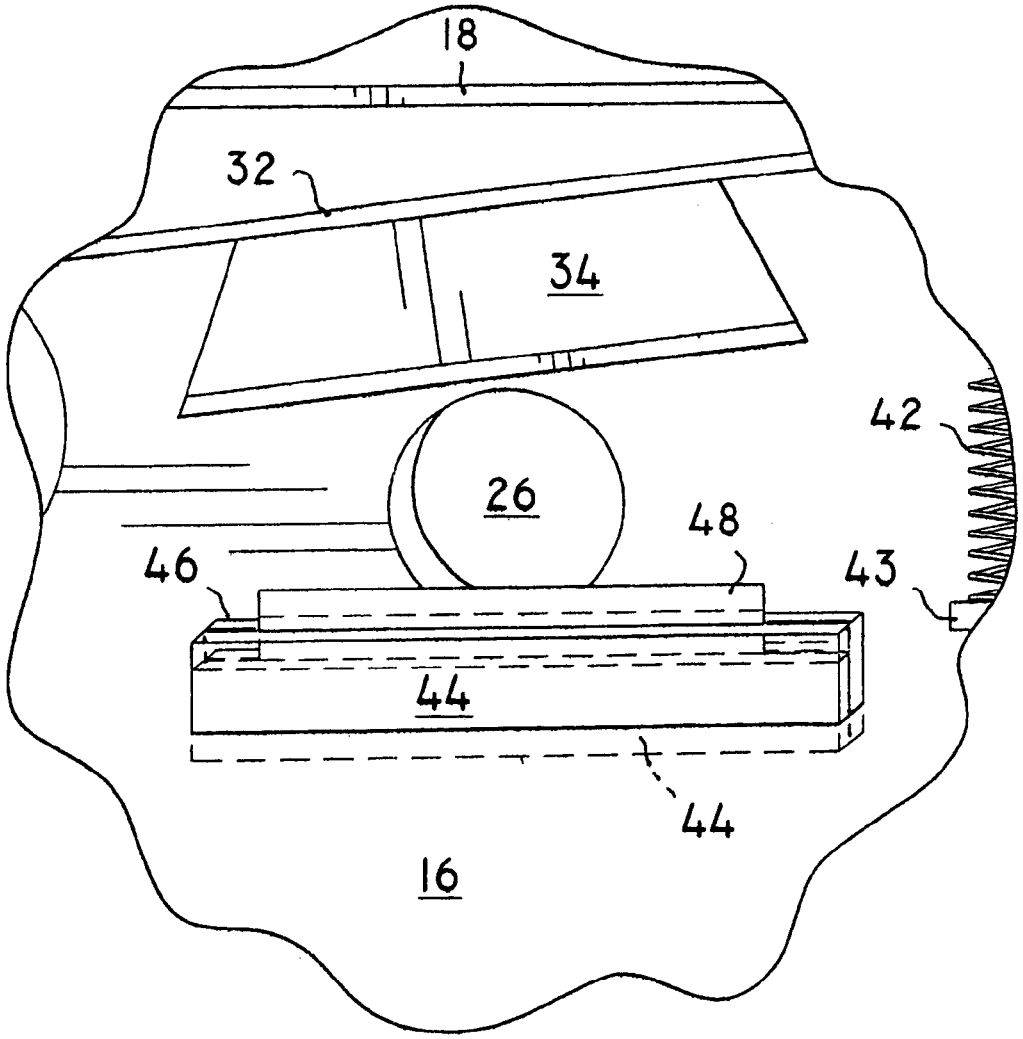
FIG. 4 is an enlarged perspective front view of the trapezoidal cutting blade and cutting block element for both embodiments of the present invention.

In another embodiment of the present invention includes a lighter component for igniting the cigarette or cigar as illustrated in FIGS. 2 and 3 as the combination device 50. The cutting portion is a modification of the first embodiment in that the thumb button 30 must be pushed in after pressing in the push-in safety pin 46 located in a notch (hidden) in the case 12 to achieve a longitudinal slicing action. The bracket 38 contains slots 37 and a compression spring 39 integral with the end of the cutting arm 32 to permit the unique slicing action of the cutting blade 34.

Provision is made in the lower region of the case 12 for adding a cigarette or cigar lighter portion. A plastic tank 52 of butane liquid 54 (hidden) is provided with a tube 56 which extends to the bottom of the tank 52. The opposite end of the tube 56 is capped by a sliding grooved cap rod 58. A push button 60 is connected perpendicularly to the cap rod 58 and to a parallel rack 60 which drives a pinion gear and axle 62 concentrically aligned on the striker wheel 64 having teeth 66 to strike the cylindrical flint 68 held in a cylindrical compartment 70. A cap 72 and an enclosed spring 74 provide the force to maintain contact of the flint 68 with the striker wheel 64. The grooved cap rod 58 has a through bore 76 which permits the butane to vaporize and ignite from the sparks 77 given off by the flint 68 as the push button 60 is pushed in. A return coil spring 78 (in shadow) is provided for there turn of the push button 60 to its original position for repetition when necessary. The spring 78 is anchored to the inside edge of the push button 60 and the inside of the left sidewall 24. It should be noted the FIG. 3 depicts an inverted case 12 for illustrative purposes.

The circular apertures 26 in the case 12 can be made in a size suitable for a cigarette or for a larger diameter cigar or cigarillo. Thus, an economical and safe cigar/cigarette cutter device either alone or in a combination with a lighter element has been shown which will permit the saving of cigarette, cigarillo and cigar butts for further smoking satisfaction.

In a more preferred embodiment of the invention, a blade is attached to a holder that moves on a track. The end of the blade holder distal from the blade edge protrudes from a notch in the side of the case. When the protruding portion of the blade carrier is pushed forward in the direction of the case, the blade moves forward across the aperture to cut any object which has been inserted into the aperture. A portion of the track in which the blade holder slides contains a spring against which pressure is exerted when the blade holder is pushed so that the blade edge traverses the aperture. This spring causes the blade to return to the original position so that the blade edge no longer occupies the aperture when the forward pressure on the blade holder is released.

Figure 5A:
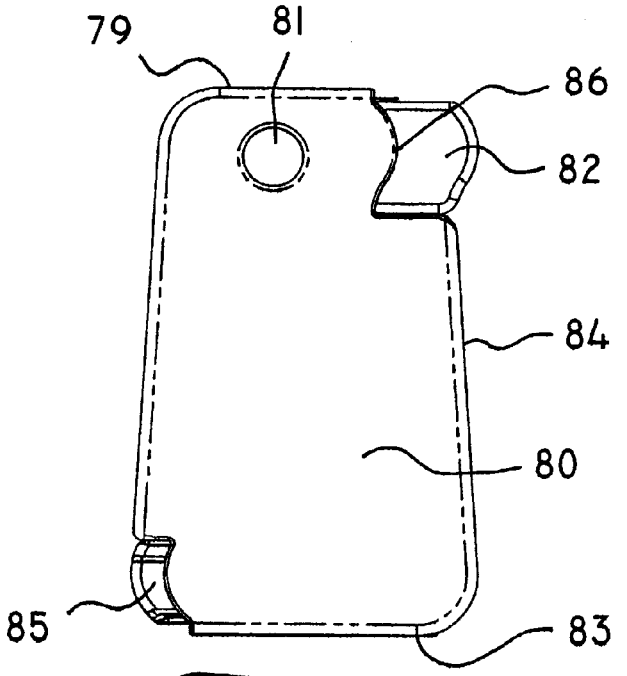
Figure 5B:
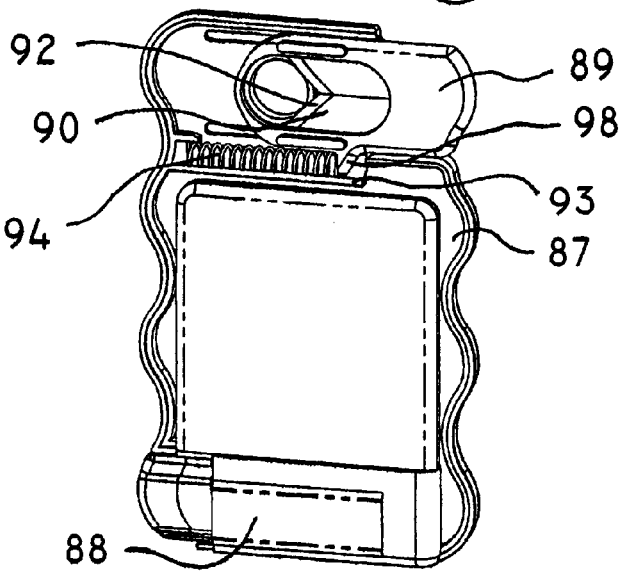
FIG. 5(B) and FIG. 5(C) show a breakaway view with the front wall removed.

For illustration of the above embodiment, See FIG. 5(A) and FIG. 5(B). These figures show the case 79 having a front wall 80 two side walls 84, a top wall 91, a bottom wall 83 and a rear wall 87 (FIG. 5(B). An aperture 81 is aligned through each of the front and rear walls. The case has a notch 86 from which there protrudes the distal portion of the blade carrier 82. FIG. 5(B) shows a breakaway view of the device with the front wall removed. An appropriate position for the lighter portion 88 is shown. The cutting component consists of a blade carrier 89 and a blade 90 having a blade cutting edge 92 which moves across the aperture 81 when pressure is applied to the blade carrier 89 which protrudes through notch 86 (FIG. 5(A)). The blade carrier travels on a track 93 so that the blade moves across the aperture. The track contains a spring 94 positioned in such a manner that it causes the blade carrier with the blade to return to its original position when pressure is released from the blade carrier portion extending through the notch, causing the blade edge to again be positioned in such a manner that it no longer impinges on the aperture 81.

The blade carrier has an extension 98 which extends in such a manner that the extension is in contact with the end of the spring which is closest to the notch so that the end of the spring is compressed when the pressure is placed on the carrier portion which extends through the notch.

Figure 5C:
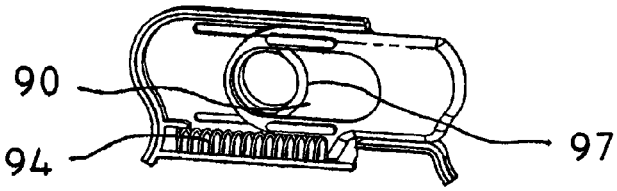

Referring to FIG. 5(C), the blade is seen having a curved edge 97, while that is FIG. 5(B) has a >-shaped edge. While circular apertures are depicted, the apertures may have other shapes, such as oval or diamond shape. Cases and other components may be made of any of a number of materials, including metal, plastic or other synthetic materials.

I claim:

1. A combination cutter and lighter device comprising:

a case having a front wall, a rear wall, a top wall, a bottom wall, and having a first sidewall and a second sidewall;

an aperture in each of said front and rear walls, wherein said apertures in said front and rear walls are aligned with each other;

a blade attached to a blade carrier, said blade carrier positioned to travel on a track which is positioned between said front and rear walls with said track ending at the first sidewall located opposite a notch in said case, and wherein said blade carrier extends outside of said case through said notch in said case;

a spring having a first end and a second end lying on said track, said track being wholly exterior to said spring, said spring being positioned in such a manner that the first end of said spring is positioned against said first sidewall opposite said notch and the second end of said spring is so positioned that said second end of said spring is against an extension of said blade carrier and so spring portions distal to said blade rest upon said track; and a lighter component positioned in said case in such a manner that it does not intrude upon any region occupied by any part of the device related to the cutting function.

2. The device of claim 1 wherein the aperture is circular.

3. The device of claim 1 wherein the case is made of plastic.

4. The device of claim 1 wherein the sidewalls are configured with gooves positioned to provide for a firm grasp of said case.

* * * * *